US007093323B2

(12) United States Patent
Morenstein et al.

(10) Patent No.: US 7,093,323 B2
(45) Date of Patent: Aug. 22, 2006

(54) ERGONOMIC HANDLE FOR A CARRYING CASE

(75) Inventors: Josh Morenstein, San Francisco, CA (US); Gad Amit, Belmont, CA (US)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

(21) Appl. No.: 10/762,205

(22) Filed: Jan. 20, 2004

(65) Prior Publication Data

US 2004/0231102 A1 Nov. 25, 2004

Related U.S. Application Data

(60) Provisional application No. 60/440,999, filed on Jan. 17, 2003.

(51) Int. Cl.
*A45C 13/22* (2006.01)

(52) U.S. Cl. ..... 16/411; 16/114.1; 16/408; 190/115; 190/117; 383/15

(58) Field of Classification Search ..... 16/411, 16/111.1, 110.1, 114.1, 408, 444, 445; 190/115, 190/117; 383/15, 17, 20
See application file for complete search history.

(56) References Cited

U.S. PATENT DOCUMENTS 1,359,461 A * 11/1920 Luce ..... 383/15
3,486,684 A * 12/1969 Wilson et al. ..... 294/171
3,784,084 A * 1/1974 Pearl ..... 383/15
4,592,091 A * 5/1986 Italici ..... 383/15
4,799,521 A * 1/1989 Shick ..... 150/107
5,265,307 A 11/1993 Hull et al.
5,440,784 A 8/1995 Hull et al.
5,996,180 A * 12/1999 Eisenzopf ..... 16/406
6,301,746 B1 10/2001 Myers et al.
6,338,180 B1 * 1/2002 Massard ..... 16/114.1
6,499,187 B1 * 12/2002 Hollingsworth ..... 16/114.1
6,687,955 B1 * 2/2004 Hollingsworth ..... 16/114.1
D507,405 S 7/2005 Kim et al.

FOREIGN PATENT DOCUMENTS

JP 2004236914 A * 8/2004

* cited by examiner

*Primary Examiner*—Brian E. Glessner
*Assistant Examiner*—Mark Williams
(74) *Attorney, Agent, or Firm*—Townsend and Townsend and Crew LLP

(57) ABSTRACT

An ergonomic handle that includes a male portion and a female portion. The male portion nest in the female portion to form a single, preferably rigid, form. The stiffness of the handle spreads the load of the case more evenly across all the fingers thereby helping to reduce fatigue.

20 Claims, 4 Drawing Sheets

ERGONOMIC HANDLE FOR A CARRYING CASE

CROSS-REFERENCES TO RELATED APPLICATIONS

This application claims priority from Provisional Application No. 60/440,999, filed Jan. 17, 2003, the disclosure of which is incorporated herein by reference.

STATEMENT AS TO RIGHTS TO INVENTIONS MADE UNDER FEDERALLY SPONSORED RESEARCH AND DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK.

NOT APPLICABLE

BACKGROUND OF THE INVENTION

1. Field of the Invention

The present invention relates to an ergonomic handle and more particularly, to an ergonomic handle that includes a male side and a female side that nest together to form a single rigid form.

2. Description of the Prior Art

People carry many types of carrying cases or bags in today's busy society. Such bags often include computer carrying cases, briefcases, luggage, etc. In today's hectic business world, people often have to travel, whether it be a short distance or a long distance, and require many different things in order to do their work or function at meetings or even give presentations. Since people use these bags to carry all types of materials, including computers, the bags or cases that people carry can become quite heavy. Thus, it is desirable to provide ergonomically appropriate features with today's carrying cases, bags, luggage, etc.

BRIEF SUMMARY OF THE INVENTION

Broadly the present invention provides an ergonomic handle that includes a male side and a female side. The male side nests in the female side to form a single, preferably rigid, form. The stiffness of the handle spreads the load of the case more evenly across all the fingers thereby helping to reduce fatigue.

More particularly, the present invention provides a handle for a carrying case. The handle includes a first portion that comprises an upper portion and a lower portion. The upper portion defines a receiving area and the lower portion defines a first carrying case engagement portion. The handle further includes a second portion that comprises an upper portion and a lower portion, with the upper portion defining a nesting part that nests within the receiving area when the handle is in use. The lower portion defines a second carrying case engagement portion. The nesting part pivots within the receiving area.

In accordance with one aspect of the present invention, the first and second carrying case portions each comprise a single elongated portion that is received by the carrying case.

In accordance with another aspect of the present invention, the first and second carrying case portions each comprise two individual parts that are received by the carrying case.

In accordance with yet another aspect of the present invention, the first portion may be separated from the second portion.

In accordance with a further aspect of the present invention, the nesting part is secured within the receiving area.

The present invention also provides a carrying case that comprises a body, at least two handle engagement portions and a handle. The handle includes a first portion that comprises an upper portion and a lower portion. The upper portion defines a receiving area and the lower portion defines a first carrying case engagement portion that engages at least one of the at least two handle engagement portions. The handle also includes a second portion that comprises an upper portion and a lower portion. The upper portion defines a nesting area that nests within the receiving area when the handle is in use. The lower portion defines a second carrying case engagement portion that engages at least one of the at least two handle engagement portions. The nesting part pivots within the receiving area.

The novel features that are characteristic of the present invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EXEMPLARY EMBODIMENTS

Figure 1A:
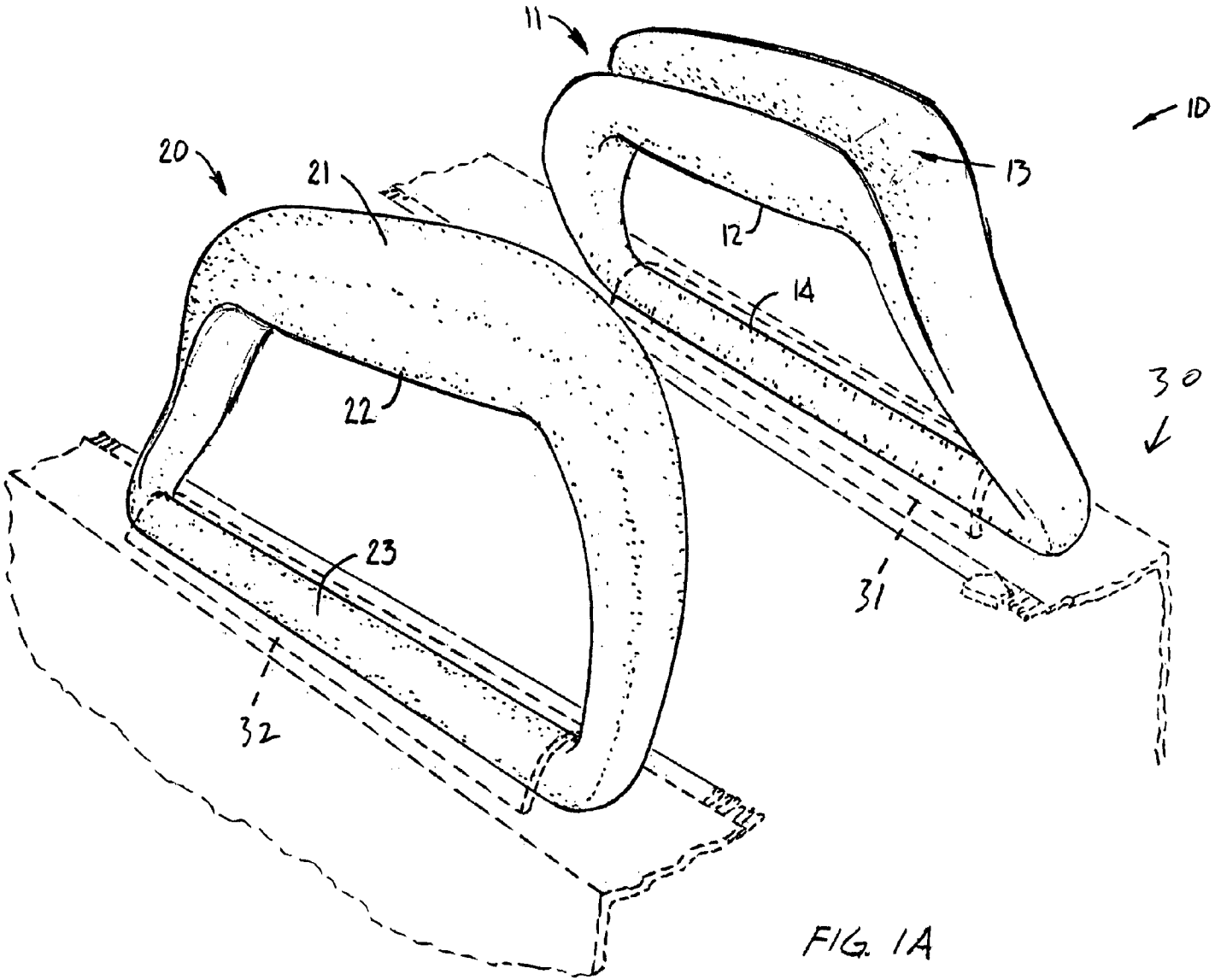
FIG. 1A is a perspective view of an ergonomic handle in accordance with its present invention.

FIG. 1A illustrates a first portion or female component 11 for an ergonomic handle 10 in accordance with the present invention. As can be seen in the figures, an upper portion 12 of the female component includes a receiving area in the form of a groove or trench 13 defined therein. A bottom portion 14 is configured to be coupled to a bag or carrying case 30. The bottom portion may be coupled with straps or by being placed into a receiving portion 31 of the bag. Those skilled in the art will understand that other arrangements for coupling to a bag are also possible.

FIG. 1A also illustrates a second portion or male component 20 for the ergonomic handle in accordance with the present invention. As can be seen, an upper portion 21 of the male component is fairly "full" and preferably includes a rounded central portion 22, preferably at least the bottom of which is rounded. A bottom portion 23 of the male component includes a portion for attaching or coupling to bag or carrying case 30. The bottom portion may be coupled with straps or by being placed into a receiving portion 32 of the bag.

As may be seen in FIGS. 1B-4, the male component nests with the female component. As may be seen, upper portion 21 of the male component nests or rests within groove or trench 13 defined within the upper portion of the female component.

Figure 1B:
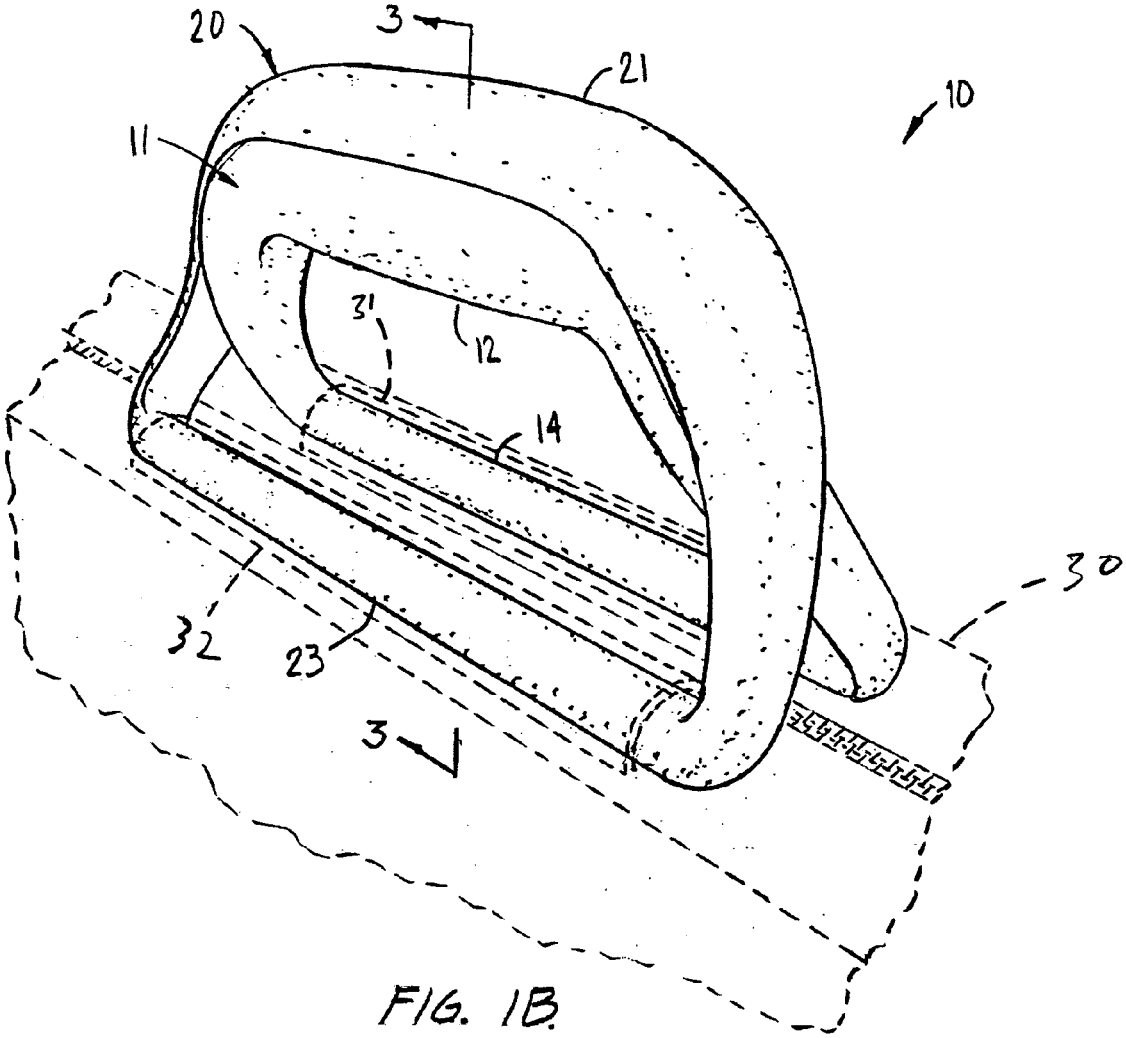
FIG. 1B is a perspective view of an ergonomic handle in accordance with the present invention in a closed and narrow orientation.
Figure 3:
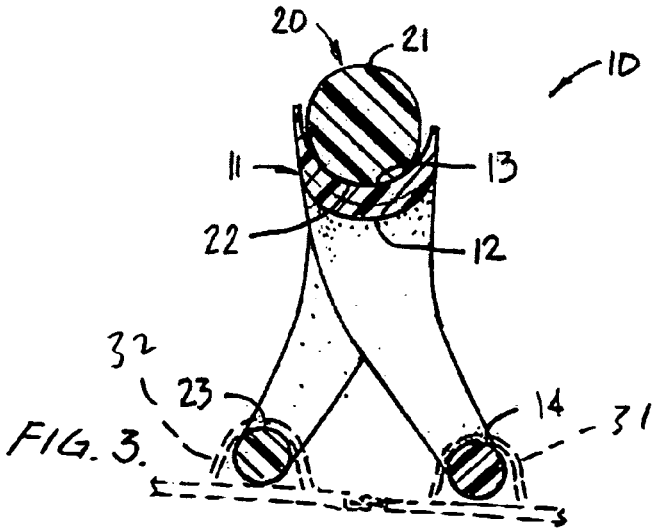
FIG. 3 is a sectional view of an ergonomic handle in accordance with the present invention.
Figure 2:
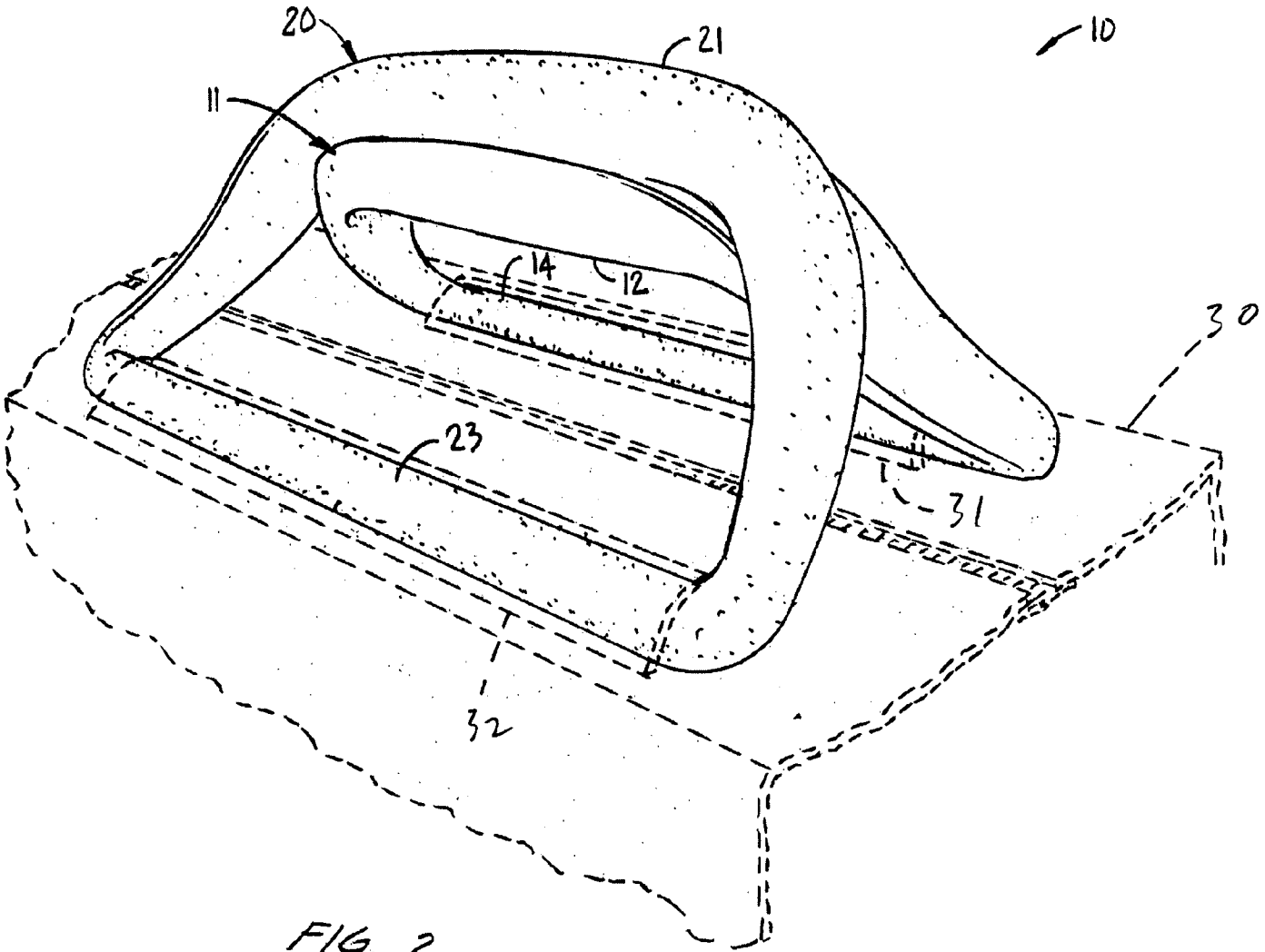
FIG. 2 is a perspective view of an ergonomic handle in accordance with the present invention in a closed and wide orientation.

FIG. 1B provides a perspective view of a narrow orientation of the ergonomic handle. FIG. 2 illustrates the ergonomic handle in a wider orientation. This is achieved by the male upper portion pivoting within the female upper portion. By allowing the handle to pivot, the handle is able to accommodate a case width range of 1–5 inches at the location where the handle is coupled to the bag (i.e., the bag may be wider than 5 inches). This allows for a wide range of applications for the narrowest of laptop sleeves to much larger roller cases. Furthermore, the handle is well suited for expandable bags. Thus, an ergonomic handle in accordance with the present invention has a wide range of uses for various bags including, for example, computer carrying cases, briefcases, filecases, luggage, etc.

Preferably, the handle is made of a rigid material such as plastic, wood, metal, etc. A soft covering may be placed over some or all of the handle components to provide comfort to the user.

The handle may be configured such that the trench walls extend up and over the male upper portion. This would allow the male upper portion to be substantially secured within the female upper portion with a snap-fit type connection.

Figure 4:
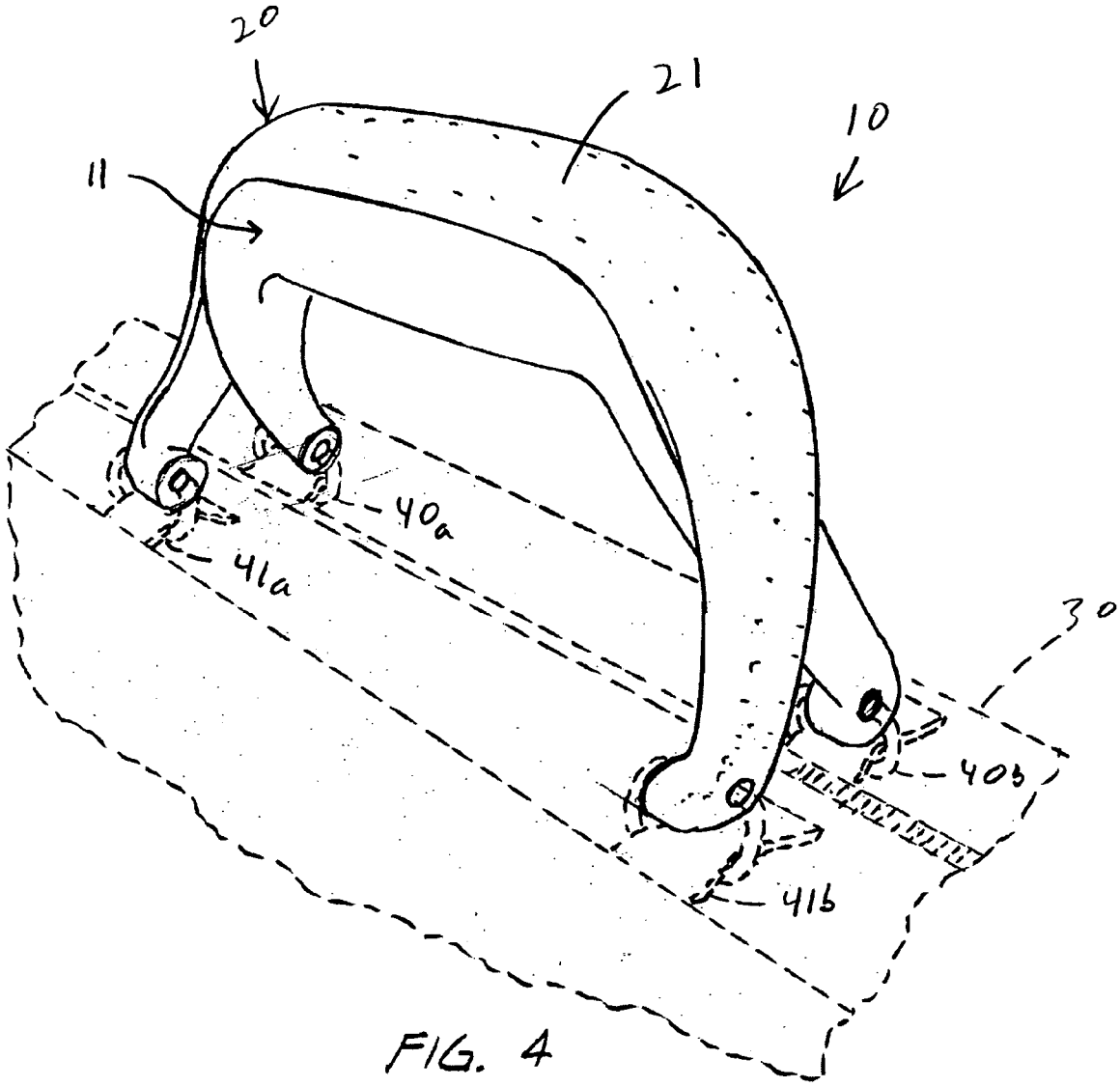
FIG. 4 is a perspective view an alternative embodiment of an ergonomic handle in accordance with the present invention.

FIG. 4 illustrates an alternative embodiment where the handle portions are each coupled to carrying case 30 at two points 40*a,b* and 41*a,b*. Those skilled in the art will understand that there are other configurations that may be used to couple the carrying case to the handle.

Examples of dimensions for the handle include an overall length of 6.30 inches for the female portion and an overall length of 6.70 inches for the male portion. The handle has an overall height of 2.80 inches for the female portion and 3.25 inches for the male portion. The trench has a radius of curvature of 0.435 inches while the male upper portion has a diameter 0.87 inches. These dimensions are merely illustrative and those skilled in the art will realize that they may be changed depending upon the desired size of the handle, the size of the carrying case, the amount of spread capability desired for the handle, etc.

The above-described arrangements of apparatus and methods are merely illustrative of applications of the principles of this invention and many other embodiments and modifications may be made without departing from the spirit and scope of the invention as defined in the claims.

What is claimed is:

1. A handle for attachment to a carrying case, the handle comprising:

a first rigid plastic portion comprising an upper portion and a lower portion, the upper portion defining a substantially horizontal receiving area and the lower portion defining a first carrying case engagement portion; and a second rigid plastic portion comprising an upper portion and a lower portion, the upper portion defining a substantially horizontal nesting part that is configured to nest within the substantially horizontal receiving area and the lower portion defining a second carrying case engagement portion, wherein the nesting part is configured to pivot within the receiving area, and the handle is configured to continue to be ergonomic as the substantially horizontal nesting part pivots within the substantially horizontal receiving area, and wherein the first carrying case engagement portion is adapted to pivot inwardly with respect to the carrying case, and wherein the second carrying case engagement portion is adapted to pivot inwardly with respect to the carrying case while the first carrying case engagement portion pivots inward;

wherein the first and second carrying case engagement portions each comprise an elongated horizontal portion that is configured to be attached to the carrying case.

2. A handle in accordance with claim 1 wherein the first portion is capable of being separated from the second portion.

3. A handle in accordance with claim 1 wherein the nesting part completely fills the receiving area, and extends above the receiving area.

4. The handle of claim 1, wherein the substantially horizontal receiving area is substantially rounded and the nesting part is substantially rounded, and wherein the substantially rounded receiving area contacts the substantially rounded nesting part and at least part of the nesting part extends above the horizontal receiving area.

5. The ergonomic handle of claim 1, wherein the receiving area is substantially rounded and the nesting part is substantially rounded, wherein the substantially rounded receiving area contacts the substantially rounded nesting part while pivoting.

6. The handle of claim 1 further comprising a soft cover covering the first rigid portion or the second rigid portion.

7. An apparatus comprising:

a carrying case;

at least two handle engagement portions; and a handle comprising a first rigid plastic portion comprising an upper portion and a lower portion, the upper portion defining a substantially horizontal receiving area and the lower portion defining a first carrying case engagement portion that engages at least one of the at least two handle engagement portions, and a second rigid plastic portion comprising an upper portion and a lower portion, the upper portion defining a substantially horizontal nesting part that is configured to nest within the substantially horizontal receiving area and the lower portion defining a second carrying case engagement portion that engages at least one of the at least two handle engagement portions, wherein the nesting part is capable of pivoting within the receiving area, and wherein the handle is configured to continue to be ergonomic when the substantially horizontal nesting part pivots within the substantially horizontal receiving area, and wherein the first carrying case engagement portion is adapted to pivot inwardly with respect to the carrying case and wherein the second carrying case engagement portion is adapted to pivot inwardly with respect to the carrying case while the first carrying case engagement portion pivots inward; wherein the first and second carrying case engagement portions each comprise an elongated horizontal portion that is configured to be attached to the carrying case.

8. An apparatus in accordance with claim 7 wherein the first and second carrying case engagement portions each comprise their elongated portion received by a respective handle engagement portion.

9. An apparatus in accordance with claim 7 wherein the carrying case comprises four handle engagement portions and the first and second carrying case engagement portions each comprise two individual parts that engage two respective handle engagement portions.

10. An apparatus in accordance with claim 7 wherein the first rigid portion is capable of being separated from the second rigid portion.

11. An apparatus in accordance with claim 7 wherein when the nesting part is configured to pivot within the receiving area, and the carrying case is capable of expanding from about 1 to about 5 inches at a location where the handle is attached to the carrying case.

12. The carrying case of claim 7, wherein the receiving area is substantially rounded and the nesting part is substantially rounded, and wherein the substantially rounded receiving area contacts the substantially rounded nesting part.

13. The apparatus of claim handle of claim 7 further comprising a soft cover covering the first rigid portion or the second rigid portion.

14. An apparatus in accordance with claim 7 wherein the first and second carrying case engagement portions are at a top region of the carrying case.

15. A method of varying dimensions of a carrying case in an apparatus including the carrying case, at least two handle engagement portions and a handle, the handle comprising a first rigid plastic portion comprising an upper portion and a lower portion, the upper portion defining a substantially horizontal receiving area and the lower portion defining a first carrying case engagement portion that engages at least one of the at least two handle engagement portions, and a second rigid plastic portion comprising an upper portion and a lower portion, the upper portion defining a substantially horizontal nesting part that nests within the substantially horizontal receiving area when the handle is in use and the lower portion defining a second carrying case engagement portion that engages at least one of the at least two handle engagement portions, wherein the nesting part is capable of pivoting within the receiving area, the method comprising:

placing the nesting part of the second rigid portion in the substantially horizontal receiving area in the first rigid portion; and pivoting the nesting part within the receiving area and also pivoting the first and second carrying case engagement portions with respect to the carrying case; and varying the width of the carrying case, wherein the handle is configured to continue to be ergonomic as the substantially horizontal nesting part pivots within the substantially horizontal receiving area; wherein the first and second carrying case engagement portions each comprise an elongated horizontal portion that is configured to be attached to the carrying case.

16. The method of claim 15, wherein the receiving area is substantially rounded and the nesting part is substantially rounded, wherein the substantially rounded receiving area contacts the substantially rounded nesting part.

17. A handle for attachment to a carrying case, the handle comprising:

a first rigid plastic portion comprising an upper portion and a lower portion, the upper portion defining a substantially horizontal receiving area and the lower portion defining a first carrying case engagement portion; and a second rigid plastic portion comprising an upper portion and a lower portion, the upper portion defining a substantially horizontal nesting part that is configured to nest within the substantially horizontal receiving area and the lower portion defining a second carrying case engagement portion, wherein the nesting part is configured to pivot within the receiving area, and the handle is configured to continue to be ergonomic as the substantially horizontal nesting part pivots within the substantially horizontal receiving area, and wherein the first carrying case engagement portion is adapted to pivot inwardly with respect to the carrying case, and wherein the second carrying case engagement portion is adapted to pivot inwardly with respect to the carrying case while the first carrying case engagement portion pivots inward; wherein the first and second carrying case engagement portions each comprise an elongated horizontal portion that is configured to be attached to the carrying case.

18. A handle in accordance with claim 17 wherein the first and second carrying case engagement portions are adapted to be attached to a top portion of the carrying case.

19. An apparatus comprising:

a carrying case;

at least two handle engagement portions; and a handle comprising a first rigid plastic portion comprising an upper portion and a lower portion, the upper portion defining a substantially horizontal receiving area and the lower portion defining a first carrying case engagement portion that engages at least one of the at least two handle engagement portions, and a second rigid plastic portion comprising an upper portion and a lower portion, the upper portion defining a substantially horizontal nesting part that is configured to nest within the substantially horizontal receiving area and the lower portion defining a second carrying case engagement portion that engages at least one of the at least two handle engagement portions, wherein the nesting part is capable of pivoting within the receiving area, and wherein the handle is configured to continue to be ergonomic when the substantially horizontal nesting part pivots within the substantially horizontal receiving area, and wherein the first carrying case engagement portion is adapted to pivot inwardly with respect to the carrying case and wherein the second carrying case engagement portion is adapted to pivot inwardly with respect to the carrying case while the first carrying case engagement portion pivots inward; wherein the first and second carrying case engagement portions each comprise an elongated horizontal portion that is configured to be attached to the carrying case.

20. An apparatus in accordance with claim 19 wherein the first and second carrying case engagement portions are at a top region of the carrying case.

* * * * *